US008242981B2

(12) United States Patent
Kim

(10) Patent No.: US 8,242,981 B2
(45) Date of Patent: Aug. 14, 2012

(54) PIXEL AND ORGANIC LIGHT EMITTING DISPLAY USING THE SAME

(75) Inventor: Yang-Wan Kim, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 826 days.

(21) Appl. No.: 12/392,313

(22) Filed: Feb. 25, 2009

(65) Prior Publication Data

US 2009/0243979 A1 Oct. 1, 2009

(30) Foreign Application Priority Data

Mar. 31, 2008 (KR) ..... 10-2008-0029768

(51) Int. Cl.
*G09G 3/36* (2006.01)

(52) U.S. Cl. ..... 345/76; 345/92

(58) Field of Classification Search ..... 345/76, 345/77, 82, 83, 92; 315/169.1
See application file for complete search history.

(56) References Cited

U.S. PATENT DOCUMENTS

| | | | | |
|---|---|---|---|---|
| 6,535,185 | B2 * | 3/2003 | Kim et al. | 345/76 |
| 6,570,338 | B2 * | 5/2003 | Bae | 315/169.3 |
| 2006/0170634 | A1 * | 8/2006 | Kwak et al. | 345/92 |
| 2007/0200814 | A1 * | 8/2007 | Kwon | 345/92 |

FOREIGN PATENT DOCUMENTS

| | | | |
|---|---|---|---|
| JP | 2007-133283 | A | 5/2007 |
| JP | 2007-171827 | A | 7/2007 |
| KR | 10-2003-0073116 | | 9/2003 |
| KR | 10-2005-0116206 | | 12/2005 |
| KR | 10-0623919 | B1 | 9/2006 |
| KR | 10-2006-0104848 | | 10/2006 |

OTHER PUBLICATIONS

Korean Office action dated Jun. 10, 2009, for priority Korean application 10-2008-0029768, noting listed references in this IDS, as well as KR 10-0623919 previously filed in an IDS dated Feb. 25, 2009.

* cited by examiner

*Primary Examiner* — Kevin M Nguyen
*Assistant Examiner* — Sepideh Ghafari
(74) *Attorney, Agent, or Firm* — Christie, Parker & Hale, LLP

(57) ABSTRACT

A pixel is provided including an OLED having anode and cathode electrodes. A second transistor controls current supplied from a first power supply to a second power supply via the OLED. A first transistor is coupled between a gate electrode of the second transistor and a data line and is configured to turn on when a scan signal is supplied to a scan line. A first capacitor is coupled between the first power supply and the gate electrode. A second capacitor is coupled between the anode electrode and the gate electrode. A fourth transistor is coupled between the second capacitor and the anode electrode and is configured to turn on when a control signal is supplied to a control line. A third transistor is coupled between the second transistor and the anode electrode and is configured to turn off when a signal is supplied to a light emitting control line.

8 Claims, 4 Drawing Sheets

PIXEL AND ORGANIC LIGHT EMITTING DISPLAY USING THE SAME

CROSS-REFERENCE TO RELATED APPLICATIONS

This application claims priority to and the benefit of Korean Patent Application No. 10-2008-0029768, filed on Mar. 31, 2008, in the Korean Intellectual Property Office, the entire content of which is incorporated herein by reference.

BACKGROUND OF THE INVENTION

1. Field of the Invention

The present invention relates to a pixel and an organic light emitting display using the same, and in particular to a pixel capable of compensating for deterioration of an organic light emitting diode and an organic light emitting display using the same.

2. Description of Related Art

Recently, various flat panel display devices with reduced weight and volume have been developed. Examples of flat panel display devices include liquid crystal displays, field emission displays, plasma display panels, and organic light emitting displays.

An organic light emitting display displays an image using an organic light emitting diode (OLED), which generates light through recombination of electrons and holes. Such an organic light emitting display has a high response speed and low power consumption.

FIG. 1 is a circuit view showing a pixel of a conventional organic light emitting display described in Korean Patent Registration No. 10-0815756. Referring to FIG. 1, a pixel 4 of the conventional organic light emitting display includes an OLED and a pixel circuit 2 coupled to a data line Dm and a scan line Sn to control the OLED.

An anode electrode of the OLED is coupled to the pixel circuit 2, and a cathode electrode of the OLED is coupled to a second power supply ELVSS. Such an OLED generates light with a luminance corresponding to current supplied from the pixel circuit 2.

The pixel circuit 2 controls the amount of current supplied to the OLED corresponding to a data signal supplied to the data line Dm when a scan signal is supplied to the scan line Sn. The pixel circuit 2 includes a second transistor M2, a first transistor M1, and a storage capacitor Cst. The second transistor M2 is coupled between a first power supply ELVDD and the OLED. The first transistor M1 is coupled between the second transistor M2, the data line Dm, and the scan line Sn. The storage capacitor Cst is coupled between a first electrode and a gate electrode of the second transistor M2.

A gate electrode of the first transistor M1 is coupled to the scan line Sn, and a first electrode of the first transistor M1 is coupled to the data line Dm. A second electrode of the first transistor M1 is coupled to one terminal of the storage capacitor Cst. The first electrode is a source electrode or a drain electrode and the second electrode is a different electrode from the first electrode. For example, if the first electrode is the source electrode, the second electrode is the drain electrode. The first transistor M1 coupled to the scan line Sn and the data line Dm is turned-on when the scan signal is supplied from the scan line Sn to supply the data signal supplied from the data line Dm to the storage capacitor Cst. The storage capacitor Cst is then charged with a voltage corresponding to the data signal.

The gate electrode of the second transistor M2 is coupled to one terminal of the storage capacitor Cst, and the first electrode of the second transistor M2 is coupled to the other terminal of the storage capacitor Cst and the first power supply ELVDD. The second electrode of the second transistor M2 is coupled to the anode electrode of the OLED. Such a second transistor M2 controls the amount of current flowing from the first power supply ELVDD to the second power supply ELVSS via the OLED corresponding to a voltage value stored in the storage capacitor Cst. The OLED generates light corresponding to the amount of current supplied from the second transistor M2.

However, there is a problem that the conventional organic light emitting display cannot display an image with desired luminance when there is an efficiency change as a result of deterioration of the OLED. In other words, the OLED degrades with time and the conventional organic light emitting display cannot display an image with a desired luminance as a result of the degradation. Effectively, light with low luminance is generated as the OLED degrades.

SUMMARY OF THE INVENTION

Aspects of embodiments of the present invention are directed toward a pixel capable of compensating for the deterioration of an organic light emitting diode and an organic light emitting diode using the same.

In an exemplary embodiment of the present invention, a pixel is provided including an organic light emitting diode, a second transistor, a first transistor, a first capacitor, a second capacitor, a fourth transistor, and a third transistor. The organic light emitting diode has an anode electrode and a cathode electrode. The second transistor controls an amount of current supplied from a first power supply to a second power supply via the organic light emitting diode. The first transistor is coupled between a gate electrode of the second transistor and a data line and is configured to turn on when a scan signal is supplied to a scan line. The first capacitor is coupled between the first power supply and the gate electrode of the second transistor. The second capacitor is coupled between a source electrode of a fourth transistor and the gate electrode of the second transistor. The fourth transistor is coupled between the second capacitor and the anode electrode and is configured to turn on when a control signal is supplied to a control line. The third transistor is coupled between the second transistor and the anode electrode and is configured to turn off when a light emitting control signal is supplied to a light emitting control line.

In one exemplary embodiment, the control line is electrically coupled to a gate electrode of the fourth transistor and the light emitting control line is electrically coupled to a gate electrode of the third transistor.

In one exemplary embodiment, the first transistor is turned on to keep the second transistor in a turned-on state during a period where voltage corresponding to a data signal provided by the data line is charged in the first capacitor.

In one exemplary embodiment, the third transistor is turned off during a period after the voltage corresponding to the data signal is charged in the first capacitor.

In one exemplary embodiment, the fourth transistor maintains a turned-on state during the period where the first transistor is turned on and the period where the third transistor is turned off.

In an exemplary embodiment of the present invention, an organic light emitting display is provided including a scan driver for driving scan lines, light emitting control lines, and first control lines; a data driver for driving data lines; and pixels at crossing regions of the scan lines and the data lines. Each of the pixels of an $i^{th}$ horizontal line, i being a natural number, includes an organic light emitting diode having an anode electrode and a cathode electrode; a second transistor for controlling an amount of current supplied from a first power supply to a second power supply via the organic light emitting diode; a first transistor coupled between a gate electrode of the second transistor and a data line and configured to turn on when a scan signal is supplied to an $i^{th}$ scan line of the scan lines; a first capacitor coupled between the gate electrode of the second transistor and the first power supply; a second capacitor coupled between the gate electrode of the second transistor and the anode electrode; a fourth transistor coupled between the second capacitor and the anode electrode and configured to turn on when a control signal is supplied to an $i^{th}$ first control line of the first control lines; and a third transistor coupled between the second transistor and the anode electrode and configured to turn off when a light emitting control signal is supplied to an $i^{th}$ light emitting control line of the light emitting control lines.

In one exemplary embodiment, the scan driver supplies the light emitting control signal to the $i^{th}$ light emitting control line after the scan signal is supplied to $i^{th}$ scan line.

In one exemplary embodiment, the scan driver supplies the control signal to the $i^{th}$ first control line to overlap the scan signal supplied to the $i^{th}$ scan line with the light emitting control signal supplied to the $i^{th}$ light emitting control line.

The pixel and the organic light emitting display using exemplary embodiments of the present invention compensate for deterioration of the organic light emitting diode, making it possible to display an image with a desired luminance. Also, according to exemplary embodiments of the present invention, even when the position of the pixels is differently set due to the voltage falling of the second power supply ELVSS, the deterioration of the organic light emitting diode can be stably compensated.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
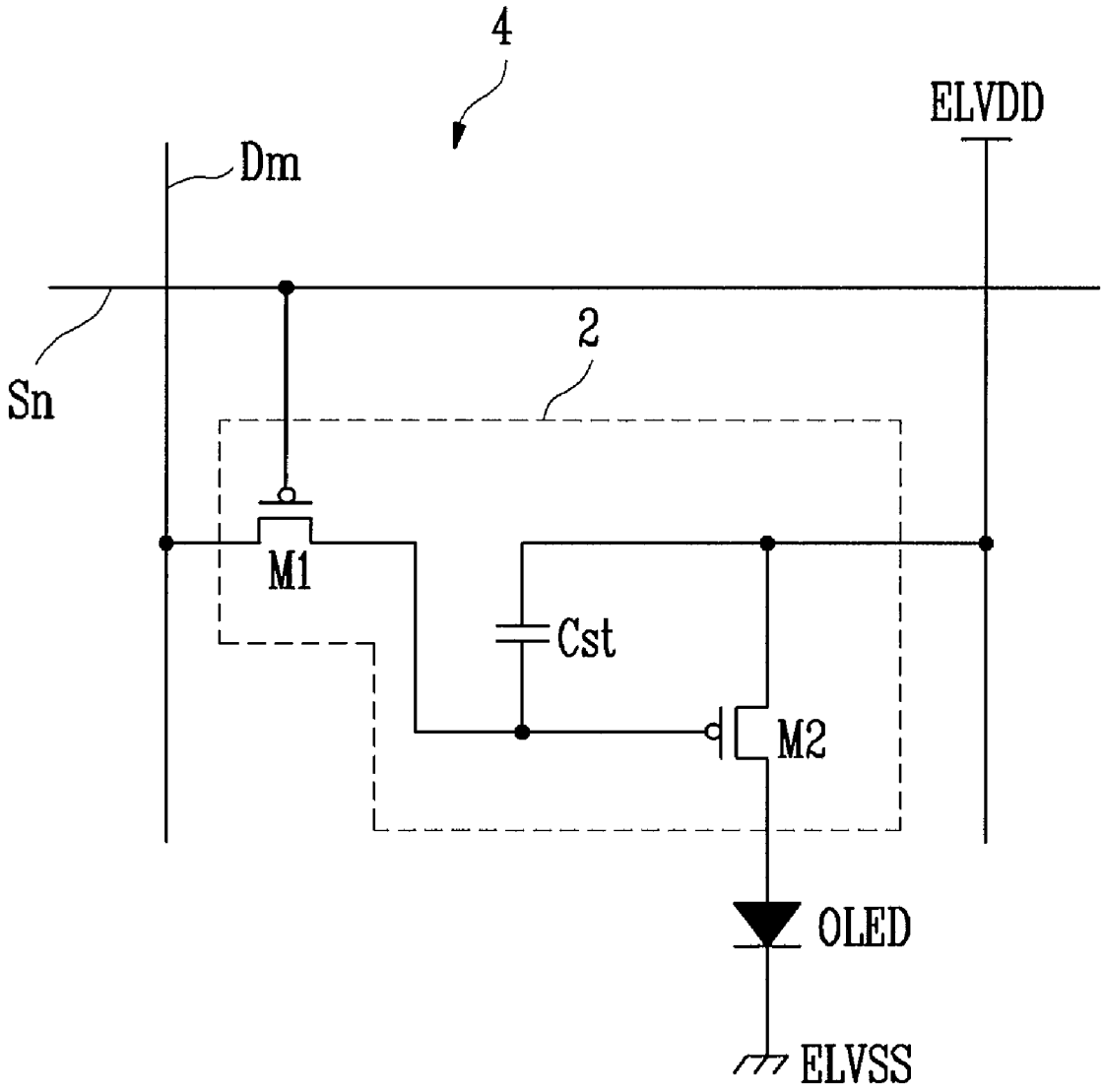
FIG. 1 (PRIOR ART)
FIG. 1 illustrates a pixel of a general organic light emitting display.

In the following detailed description, only certain exemplary embodiments of the present invention are shown and described, by way of illustration. As those skilled in the art would recognize, the invention may be embodied in many different forms and should not be construed as being limited to the embodiments set forth herein. Like reference numerals designate like elements throughout the specification.

Figure 2:
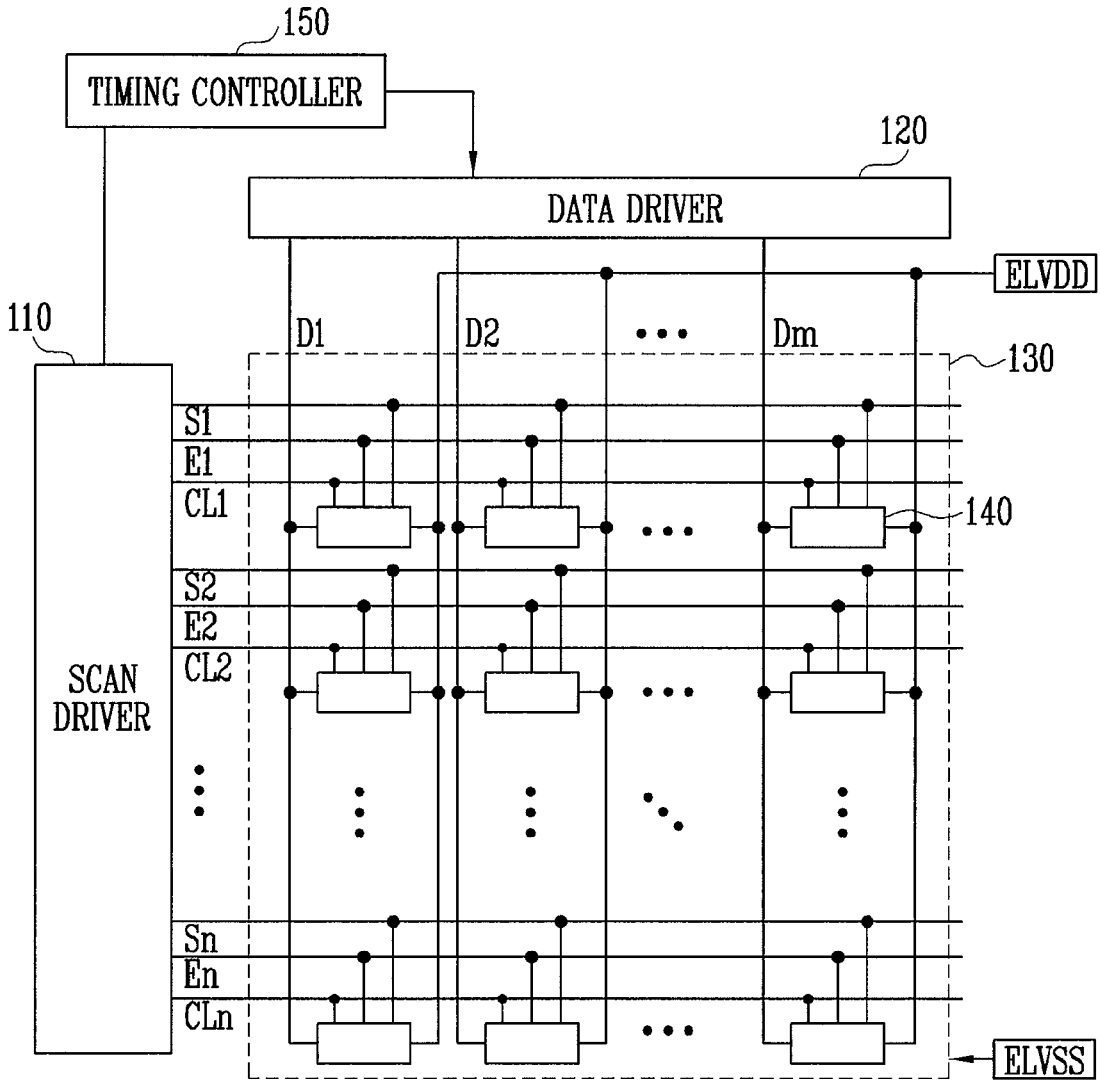
FIG. 2 illustrates an organic light emitting display according to an exemplary embodiment of the present invention.

FIG. 2 illustrates an organic light emitting display according to an exemplary embodiment of the present invention. The organic light emitting display includes a display area/region (or pixel unit) 130, a scan driver 110, a data driver 120, and a timing controller 150. The display area 130 includes pixels 140 at crossing regions (or intersection parts) of scan lines S1 to Sn, light emitting control lines E1 to En, control lines (or first control lines) CL1 to CLn, and data lines D1 to Dm. The scan driver 110 drives the scan lines S1 to Sn, the light emitting control lines E1 to En, and the control lines CL1 to CLn, and the data driver 120 drives the data lines D1 to Dm. The timing controller 150 controls the scan driver 110 and the data driver 120.

The scan driver 110 generates scan signals (low voltage) according to the control of the timing controller 150, and sequentially supplies the generated scan signals to the scan lines S1 to Sn. The scan driver 110 generates light emitting control signals (high voltage), and sequentially supplies the generated light emitting control signals to the light emitting control lines E1 to En. The light emitting control signals, which are supplied to the $i^{th}$ (i is natural number) light emitting control line Ei, are supplied after the scan signal is supplied to the $i^{th}$ scan line Si. In other words, the light emitting control signal supplied to the $i^{th}$ light emitting control line Ei and the scan signal supplied to the $i^{th}$ scan line Si are not overlapped with each other.

Also, the scan driver 110 generates the control signal (low voltage) and sequentially supplies the generated control signal to the control lines CL1 to CLn. The control signal supplied to the $i^{th}$ control line CLi is supplied to be overlapped with the scan signal supplied to the $i^{th}$ scan line Si and the light emitting control signal supplied to the $i^{th}$ light emitting control line Ei.

The data driver 120 generates data signals according to the control of the timing controller 150 and supplies the generated data signals to the data lines D1 to Dm in synchronization with the scan signals The timing controller 150 controls the scan driver 110 and the data driver 120. Also, the timing controller 150 provides externally supplied data to the data driver 120.

The display area 130 receives power of a first power supply ELVDD and power of a second power supply ELVSS from the exterior and supplies the powers to the pixels 140, respectively. Each pixel 140 receiving the power of first power supply ELVDD and the power of the second power supply ELVSS generates light corresponding to the data signals. The pixels 140 compensate for deterioration of the organic light emitting diode included therein, making it possible to generate light with desired luminance.

Figure 3:
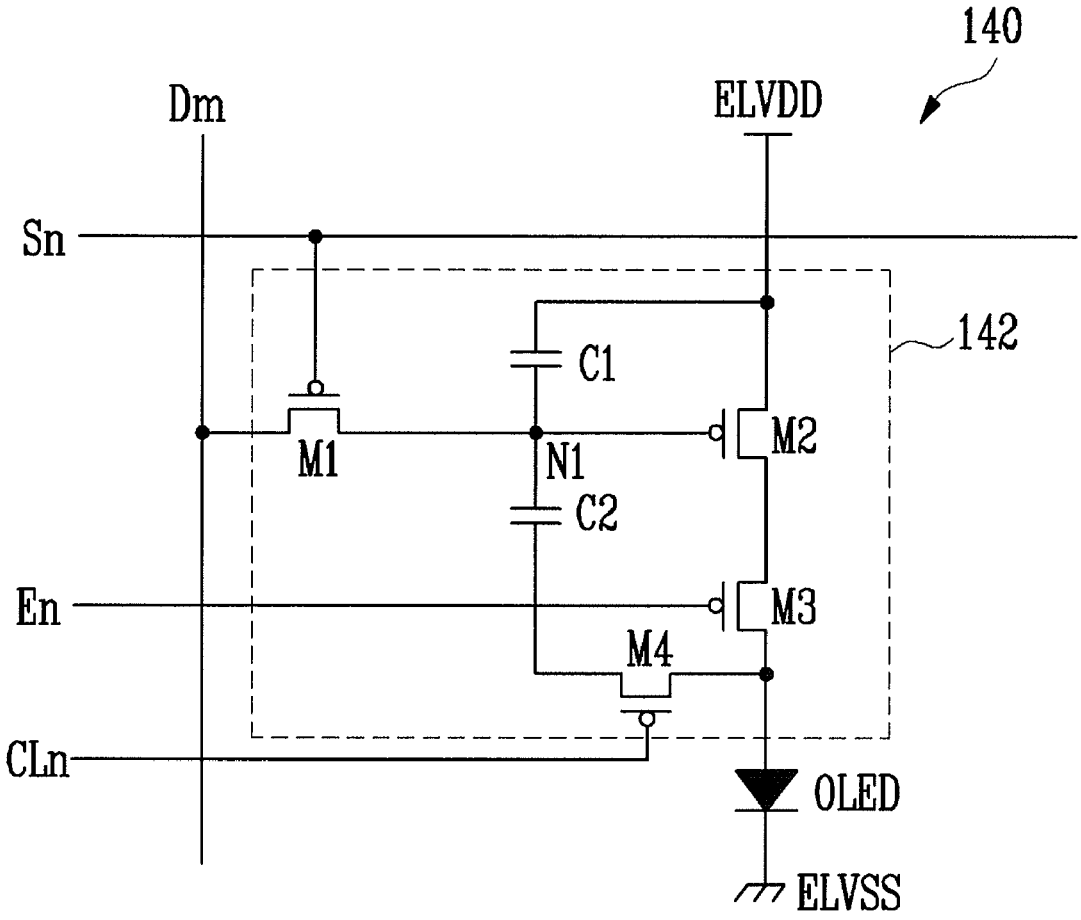
FIG. 3 is a circuit diagram of a pixel shown in FIG. 2.

FIG. 3 is a circuit diagram showing a pixel according to an exemplary embodiment of the present invention. For convenience, only a pixel coupled with an $n^{th}$ scan line Sn and an $m^{th}$ data line Dm is shown in the FIG. 3.

Referring to the FIG. 3, the pixel according to an exemplary embodiment of the present invention includes a pixel circuit 142 coupled to an OLED, a data line Dm, a scan line Sn, a light emitting line En, and a control line CLn to control the OLED.

An anode electrode of the OLED is coupled to the pixel circuit 142, and a cathode electrode of the OLED is coupled to the second power supply ELVSS. The OLED generates light with a luminance (e.g., a predetermined luminance) corresponding to current supplied from the pixel circuit 142.

The pixel circuit 142 receives the data signal from the data line Dm when the scan signal is supplied to the scan line Sn. The pixel circuit 142 receiving the data signal controls the amount of current supplied to the OLED corresponding to the data signal.

Also, the pixel circuit 142 controls the voltage of a gate electrode of a second transistor M2 (drive transistor) to compensate for the deterioration of the OLED corresponding to the control signal and the light emitting control signal. The pixel circuit 142 includes a first transistor M1, the second transistor M2, a third transistor M3, a fourth transistor M4, a first capacitor C1, and a second capacitor C2.

The gate electrode of the first transistor M1 is coupled to the scan line Sn, the first electrode of the first transistor M1 is coupled to the data line Dm. The second electrode of the first transistor M1 is coupled to the gate electrode of the second transistor M2 (that is, a first node N1). The first transistor M1 is turned-on when the scan signal is supplied to the scan line Sn to supply the data signal supplied from the data line Dm to the gate electrode of the second transistor M2.

The gate electrode of the second transistor M2 is coupled to the second electrode of the first transistor M1, and the first electrode of the second transistor M2 is coupled to the first power supply ELVDD. The second electrode of the second transistor M2 is coupled to the first electrode of the third transistor M3. The second transistor M2 controls the amount of current flowing from the first power supply ELVDD to the second power supply ELVSS via the OLED corresponding to a voltage provided to its gate electrode.

The first electrode of the third transistor M3 is coupled to the second electrode of the second transistor M2, and the second electrode of the third transistor M3 is coupled to the anode electrode of the OLED. The gate electrode of the third transistor M3 is coupled to the light emitting control line En. The third transistor M3 is turned-off when the light emitting control signal is supplied to the light emitting control line En, but is turned-on in other cases.

The first electrode of the fourth transistor M4 is coupled to the anode electrode of the OLED, and the second electrode of the fourth transistor M4 is coupled to a first terminal of the second capacitor C2. The gate electrode of the fourth transistor M4 is coupled to the control line CLn. The fourth transistor M4 is turned-on when the control signal is supplied to the control line CLn.

The first capacitor C1 is between the first power supply ELVDD and the first node N1. The first capacitor C1 is charged with a voltage corresponding to the data signal.

The second capacitor C2 is coupled between the first node N1 and a source electrode of the fourth transistor M4. The second capacitor C2 changes a voltage of the first node N1 corresponding to a voltage change of the anode electrode of the OLED.

Figure 4:
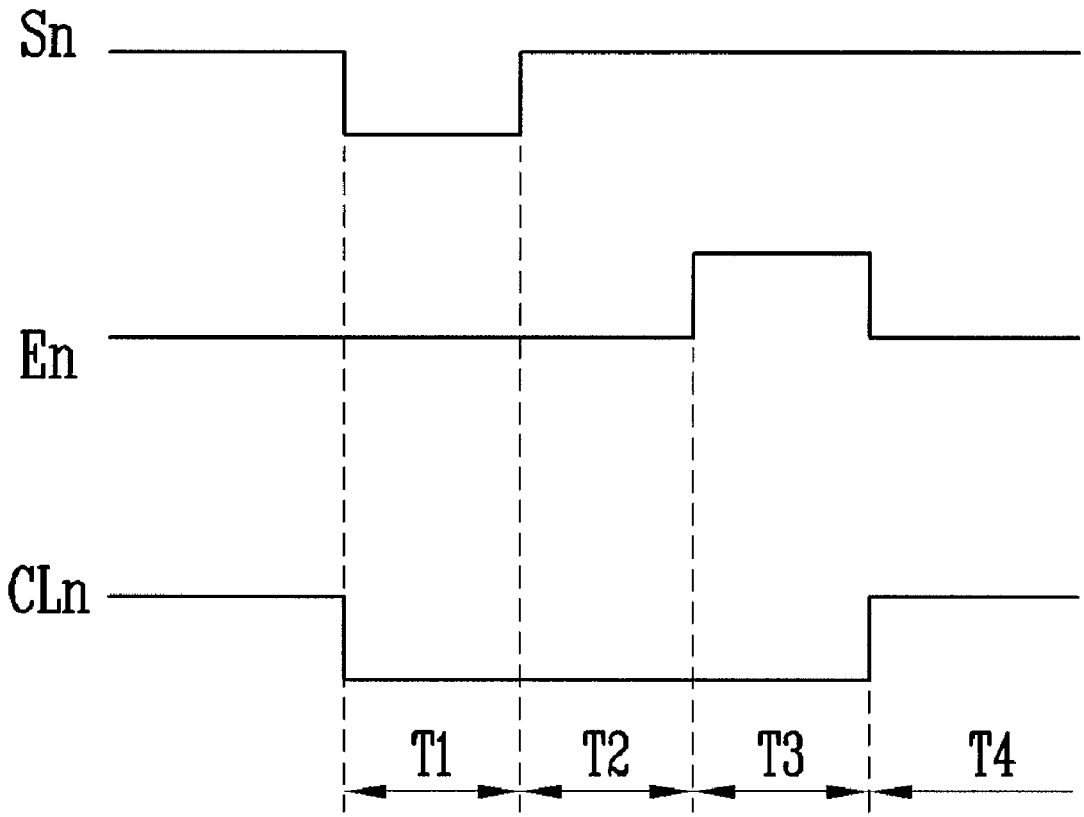
FIG. 4 is a waveform view showing a method of driving the pixel shown in FIG. 3.

FIG. 4 is a waveform view showing a method of driving the pixel shown in FIG. 3. Referring to the FIG. 4, the scan signal is first supplied to the scan line Sn, and the control signal is supplied to the control line CLn, during a first period T1.

If the scan signal is supplied to the scan line Sn, the first transistor M1 is turned-on. If the first transistor M1 is turned-on, the data signal is supplied from the data line Dm to the first node N1. If the data signal is supplied to the first node N1, voltage corresponding to the data signal is charged in the first capacitor C1.

If the control signal is supplied to the control line CLn, the fourth transistor M4 is turned-on. When the fourth transistor M4 is turned-on, the anode electrode of the OLED and the first terminal of the second capacitor C2 are electrically coupled.

The second transistor M2 supplies a current (e.g., a predetermined current) to the OLED corresponding to the data signal supplied to the first node N1 during a first period T1. A first voltage corresponding to the amount of current supplied from the second transistor M2 is supplied to the OLED. The first voltage applied to the OLED is supplied to the first terminal of the second capacitor C2 via the fourth transistor M4.

A supply of the scan signal is suspended during a second period T2. If the supply of the scan signal is interrupted, the first transistor M1 is turned-off to suspend the supply of the data signal. Meanwhile, the second transistor M2 supplies a current (e.g., a predetermined current) corresponding to the voltage charged in the first capacitor C1 to the OLED so that the first terminal of the second capacitor C2 maintains the first voltage.

The light emitting control signal is supplied to the light emitting control line En during a third period T3. If the light emitting control signal is supplied to the light emitting control line En, the third transistor M3 is turned-off. If the third transistor M3 is turned-off, current is not supplied from the second transistor M2 to the OLED. In this case, the anode electrode of the OLED is applied with the second voltage corresponding to the threshold voltage of the OLED. Accordingly, the first terminal of the first capacitor C2 is supplied with the second voltage during the third period T3. Herein, the second voltage is lower than the first voltage.

The voltage of the first node N1, set to a floating state during the third period T3, is changed corresponding to the voltage change of the OLED. In other words, the voltage of the first node N1 falls by the voltage ΔV, which is a difference between the first voltage and the second voltage.

As the OLED deteriorates, the resistance of the OLED increases. If the resistance of the OLED increases, the voltage of the ΔV subtracting the second voltage from the first voltage increases. In other words, a falling range (or width) of voltage of the first node N1 increases as the OLED deteriorates so that the deterioration of an OLED can be compensated.

As such, the ΔV is determined irrespective of the voltage of the second power supply ELVSS. That is, the voltage of the ΔV is determined irrespective of the voltage of the second power supply ELVSS when subtracting the second voltage from the first voltage so that the deterioration of the OLED can be compensated without the effect of the second power supply ELVSS. In other words, in exemplary embodiments of the present invention, even when the position of the pixels is differently placed due to the voltage falling of the second power supply ELVSS, the deterioration of the organic light emitting diode can stably be compensated.

Also, the supply of the control signal and the light emitting control signal is suspended during the fourth period T4. If the supply of the control signal is suspended, the fourth transistor M4 is turned-off. If the supply of the light emitting control signal is suspended, the third transistor M3 is turned-on. If the third transistor M3 is turned-on, the current corresponding to the voltage applied from the second transistor M2 to the first node N1 is supplied to the OLED. Then, light with a luminance (e.g., a predetermined luminance) is generated from the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode having an anode electrode and a cathode electrode;

a second transistor for controlling an amount of current supplied from a first power supply to a second power supply via the organic light emitting diode;

a first transistor coupled between a gate electrode of the second transistor and a data line and configured to turn on when a scan signal is supplied to a scan line;

a first capacitor coupled between the first power supply and the gate electrode of the second transistor;

a second capacitor electrically connected between a source electrode of a fourth transistor and the gate electrode of the second transistor;

the fourth transistor coupled between the second capacitor and the anode electrode and configured to turn on when a control signal is supplied to a control line; and a third transistor coupled between the second transistor and the anode electrode and configured to turn off when a light emitting control signal is supplied to a light emitting control line.

2. The pixel according to claim 1, wherein the control line is electrically coupled to a gate electrode of the fourth transistor and the light emitting control line is electrically coupled to a gate electrode of the third transistor.

3. The pixel according to claim 1, wherein the first transistor is turned on to keep the second transistor in a turned-on state during a period where voltage corresponding to a data signal provided by the data line is charged in the first capacitor.

4. The pixel according to claim 3, wherein the third transistor is turned off during a period after the voltage corresponding to the data signal is charged in the first capacitor.

5. The pixel according to claim 4, wherein the fourth transistor maintains a turned-on state during the period where the first transistor is turned on and the period where the third transistor is turned off.

6. An organic light emitting display comprising:

a scan driver for driving scan lines, light emitting control lines, and first control lines;

a data driver for driving data lines; and pixels at crossing regions of the scan lines and the data lines, wherein each of the pixels of an $i^{th}$ horizontal line, i being a natural number, comprises:

an organic light emitting diode having an anode electrode and a cathode electrode;

a second transistor for controlling an amount of current supplied from a first power supply to a second power supply via the organic light emitting diode;

a first transistor coupled between a gate electrode of the second transistor and a data line and configured to turn on when a scan signal is supplied to an $i^{th}$ scan line of the scan lines;

a first capacitor coupled between the gate electrode of the second transistor and the first power supply;

a second capacitor electrically connected between a source electrode of a fourth transistor and a node (N1);

the fourth transistor coupled between the second capacitor and the anode electrode and configured to turn on when a control signal is supplied to an $i^{th}$ first control line of the first control lines; and a third transistor coupled between the second transistor and the anode electrode and configured to turn off when a light emitting control signal is supplied to an $i^{th}$ light emitting control line of the light emitting control lines.

7. The organic light emitting display according to claim 6, wherein the scan driver supplies the light emitting control signal to the $i^{th}$ light emitting control line after the scan signal is supplied to $i^{th}$ scan line.

8. The organic light emitting display according to claim 7, wherein the scan driver supplies the control signal to the $i^{th}$ first control line to overlap the scan signal supplied to the $i^{th}$ scan line with the light emitting control signal supplied to the $i^{th}$ light emitting control line.

* * * * *